US006101856A

United States Patent [19]

Pelletier et al.

[11] Patent Number: 6,101,856

[45] Date of Patent: Aug. 15, 2000

[54] FREE-WHEELING LEVER HANDLE LOCK MECHANISM

[75] Inventors: Thomas A. Pelletier, Wallingford, Conn.; Ronald S. Slusarski, Narragansett, R.I.; David A. Sorensen, Hamden, Conn.

[73] Assignee: Sargent Manufacturing Company, New Haven, Conn.

[21] Appl. No.: 09/210,919

[22] Filed: Dec. 14, 1998

[51] Int. Cl.[7] ..... E05B 13/10

[52] U.S. Cl. ..... 70/472; 70/223; 70/224

[58] Field of Search ..... 70/149, 218, 221–224, 70/422, 472; 292/DIG. 27

[56] References Cited

U.S. PATENT DOCUMENTS

| | | | |
|---|---|---|---|
| 1,714,286 | 5/1929 | Waldo . | |
| 1,769,314 | 7/1930 | Rymer . | |
| 1,779,438 | 10/1930 | Lowe . | |
| 1,834,223 | 12/1931 | Rymer . | |
| 1,855,697 | 4/1932 | Sullivan . | |
| 1,871,442 | 8/1932 | Benzee . | |
| 1,897,523 | 2/1933 | Marple . | |
| 1,899,686 | 2/1933 | Heust . | |
| 1,899,996 | 3/1933 | Sullivan . | |
| 1,899,997 | 3/1933 | Sullivan . | |
| 1,960,410 | 5/1934 | Christensen . | |
| 2,062,598 | 12/1936 | Nelsen | 70/91 |
| 2,175,791 | 10/1939 | Brauning | 70/146 |
| 2,197,508 | 4/1940 | Peo | 292/352 |
| 2,634,598 | 4/1953 | Kaiser | 70/146 |
| 2,672,041 | 3/1954 | Heyer | 70/223 |
| 3,381,508 | 5/1968 | Carlson et al. | 70/216 |
| 3,621,685 | 11/1971 | Saurgent | 70/422 X |
| 3,718,015 | 2/1973 | Tornoe et al. | 70/224 |
| 3,800,573 | 4/1974 | Babb, Jr. et al. | 70/217 |
| 3,856,339 | 12/1974 | Tornoe et al. | 292/336.3 |
| 3,881,331 | 5/1975 | Tranberg et al. | 70/107 |
| 3,896,644 | 7/1975 | Nagy et al. | 70/149 |
| 3,922,896 | 12/1975 | Kagoura | 70/223 |
| 3,955,387 | 5/1976 | Best et al. | 70/224 |
| 4,031,725 | 6/1977 | Reid | 70/107 |
| 4,108,482 | 8/1978 | Dietrich et al. | 292/165 |
| 4,236,396 | 12/1980 | Surko, Jr. et al. | 70/107 |
| 4,333,324 | 6/1982 | Dietrich et al. | 70/107 |
| 4,429,556 | 2/1984 | Kambic | 70/149 |
| 4,437,695 | 3/1984 | Foshee | 292/352 |
| 4,470,279 | 9/1984 | Neary et al. | 70/134 |
| 4,594,864 | 6/1986 | Hart | 70/143 |
| 4,631,944 | 12/1986 | Gater et al. | 70/472 |
| 4,648,639 | 3/1987 | Martin et al. | 292/167 |
| 4,655,059 | 4/1987 | Best et al. | 70/224 |
| 4,660,395 | 4/1987 | Huang et al. | 70/351 |
| 4,671,087 | 6/1987 | Olenfalk et al. | 70/218 X |
| 4,672,829 | 6/1987 | Gater et al. | 70/472 |
| 4,920,773 | 5/1990 | Surko, Jr. | 70/224 |
| 4,921,289 | 5/1990 | Shen | 292/336.3 |
| 5,018,375 | 5/1991 | Tully | 70/472 |
| 5,056,835 | 10/1991 | Johnson | 292/207 |
| 5,727,406 | 3/1998 | Banducci | 70/224 |
| 5,809,815 | 9/1998 | Lee | 70/472 |
| 5,868,018 | 2/1999 | Kang | 70/422 X |
| 5,904,232 | 5/1999 | Shen | 292/DIG. 27 X |
| B1 4,920,773 | 1/1997 | Surko, Jr. | 70/224 |

FOREIGN PATENT DOCUMENTS 2140070 11/1984 United Kingdom .

*Primary Examiner*—Lloyd A. Gall
*Attorney, Agent, or Firm*—DeLio & Peterson, LLC

[57] ABSTRACT

A free-wheeling lock mechanism for a cylindrical door lock includes inner and outer spindles directly connected to corresponding inner and outer lever handles, a latch retractor located between the spindles and a cylindrical outer cam located within the outer spindle. The outer cam has an ear on its perimeter that moves from a forward to a rearward position as the outer cam is rotated to operate the latch retractor. A cylindrical locking plug is located within the outer cam and has an outwardly projecting finger that connects and disconnects the outer cam from the outer spindle to lock and unlock the mechanism as the locking plug slides axially relative to the outer cam. In the unlocked position the finger projects outwardly through a slot in the outer cam into a longitudinally oriented portion of a T-shaped slot in the spindle. In the locked position the finger projects outwardly through the outer cam slot into a circumferential portion of the spindle slot.

21 Claims, 7 Drawing Sheets

FREE-WHEELING LEVER HANDLE LOCK MECHANISM

BACKGROUND OF THE INVENTION

1. Field of the Invention

The present invention relates to door locks. More particularly, this invention relates to the locking mechanism in door locks in which the handle is allowed to "free-wheel", i.e., rotate without retracting the latchbolt, when the mechanism is locked.

2. Description of Related Art

Doors are much easier to open when the door handle is shaped as a lever handle rather than a conventional door knob. For this reason, lever handles are preferred in some applications, and they may be required under applicable regulations for certain doors in public buildings to facilitate access by the disabled and the elderly.

However, the lever shape of the door handle allows much greater force to be applied to the internal locking mechanism of the door than can be applied with a round door knob. In most door locks, the locking mechanism prevents the door knob from turning when the door is locked. When a round door knob is replaced by a lever handle, the greater leverage available from such a handle may allow a vandal or thief to break the internal components of the door lock by standing or jumping on the lever end of the handle. This problem is particularly acute for cylindrical locks which have less internal room than mortise type locks to accommodate heavy duty locking components.

To address this problem, the present invention has been designed such that the outer lever handle is disengaged from the locking mechanism and allowed to free-wheel when the door lock mechanism is locked. This allows the lever handle to rotate freely without operating the locking mechanism and prevents the lever handle from being used to overstress the internal components of the lock.

Free-wheeling door locks which have previously been developed have been expensive due to the large number of parts, the multiple manufacturing steps needed to make the parts and the difficulty of assembly of the lock at the factory. The present invention addresses these problems through a design which includes relatively fewer parts and simpler parts that can be manufactured with fewer steps and which are quickly and easily assembled in the factory and in the field.

Bearing in mind the problems and deficiencies of the prior art, it is therefore an object of the present invention to provide a free-wheeling lever handle lock mechanism that is relatively less expensive to construct and assemble than prior art free-wheeling lock mechanisms.

It is another object of the present invention to provide a free-wheeling lever handle lock mechanism that has fewer components than prior art free-wheeling lock mechanisms, and where the components are easy to manufacture and assemble.

Still other objects and advantages of the invention will in part be obvious and will in part be apparent from the specification.

SUMMARY OF THE INVENTION

The above and other objects, which will be apparent to those skilled in art, are achieved in the present invention which is directed to a free-wheeling lock mechanism including a latch retractor and a spindle adapted for non-rotatable connection to a handle. The spindle has a spindle slot formed in it with a portion of the slot being longitudinally oriented and a portion of the slot being circumferentially oriented.

Inside the spindle is an outer cam having an outer cam ear and an outer cam slot. The outer cam can rotate within the spindle and the outer cam ear retracts the latch retractor when the outer cam is turned. Inside the outer cam is a locking plug having an outwardly projecting finger. The locking plug is axially slidable relative to the outer cam and the spindle from an unlocked position to a locked position. In the unlocked position the finger projects outwardly through the outer cam slot into the longitudinal portion of the spindle slot. In this position the finger couples the outer cam to the spindle so that rotation of the handle turns the spindle and the outer cam, thereby retracting the latch via the rotational motion of the outer cam ear.

In the locked position the finger projects outwardly through the outer cam slot into the circumferential portion of the spindle slot. The circumferential portion of the slot allows the spindle to turn without turning the outer cam or retracting the latch.

In a first aspect of the invention the free-wheeling lock mechanism also includes an inner cam having an inner cam ear capable of operating the latch retractor. The inner cam is rotatably held within the outer cam and holds the locking plug inside it. The inner cam ear is driven by a lock cylinder assembly operated by a key which allows the latch retractor to be pulled back by the inner cam ear independently of the rotation of the handle, spindle or outer cam ear.

In a second aspect, the invention omits the inner cam and uses a locking plug with a spiral groove. In the preferred construction of this embodiment, the outer cam includes a pin that engages the spiral groove. A lock cylinder assembly operated by a key turns the locking plug which causes it to slide axially relative to the outer cam and spindle. This moves the finger from the longitudinal portion of the spindle slot to the circumferential portion of the spindle slot to lock the mechanism.

In the preferred embodiment of the invention, the free-wheeling lock mechanism further includes a locking plug spring positioned in a central opening of the inner cam. The central opening is at least partially closed at one end thereof and also receives the locking plug. The locking plug spring biases the locking plug to axially slide the finger into the longitudinal portion of the spindle slot. In this embodiment the inner cam includes a capture slot and the locking plug is held in the inner cam by a pin projecting outwardly into the capture slot. The capture slot allows the locking plug and inner cam to move axially and rotationally relative to each other sufficiently to move between the locked and unlocked positions, but otherwise limits the relative motion to keep the inner cam, locking plug and locking plug spring in a fully assembled relationship.

In the preferred design, the inner cam ear and the outer cam ear lie substantially in a plane perpendicular to the axis of the spindle adjacent to a side of the latch retractor. The free-wheeling lock mechanism of the preferred design also includes a lever handle having a hollow shaft receiving and engaging the spindle and a rose having a spring supporting the lever handle in a horizontal orientation. The rose includes members extending through the door to prevent the rose from rotating, the members and rose being adapted for mounting at a plurality of angular orientations relative to the door to accommodate differing mounting hole locations on the door while continuing to support the lever handle in a horizontal orientation.

In another aspect of the invention, the spindle rotates in a bearing having a locking slot and the finger projects outwardly through the circumferential portion of the spindle slot into the bearing locking slot when the locking plug is in the locked position. Because the bearing is fixed relative to the door, when the finger enters the bearing locking slot the outer cam (which operates the latch retractor) is prevented from turning. This allows the finger to perform two separate functions when the door is locked, first—disconnecting the spindle from the outer cam to allow the handle to free-wheel and second—preventing the outer cam from turning.

In this aspect of the invention, the bearing preferably includes an arcuate rabbet and the finger projects outwardly through the longitudinal portion of the spindle slot into the rabbet when the locking plug is in the unlocked position. The finger rotates in the rabbet when the spindle is rotated. The rabbet is also used in the preferred design to hold the spindle into the lock. This is achieved by adding a protrusion on an end of the spindle which is captured by the rabbet.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENTS

In describing the preferred embodiment of the present invention, reference will be made herein to FIGS. 1–7 of the drawings in which like numerals refer to like features of the invention.

Figure 1:
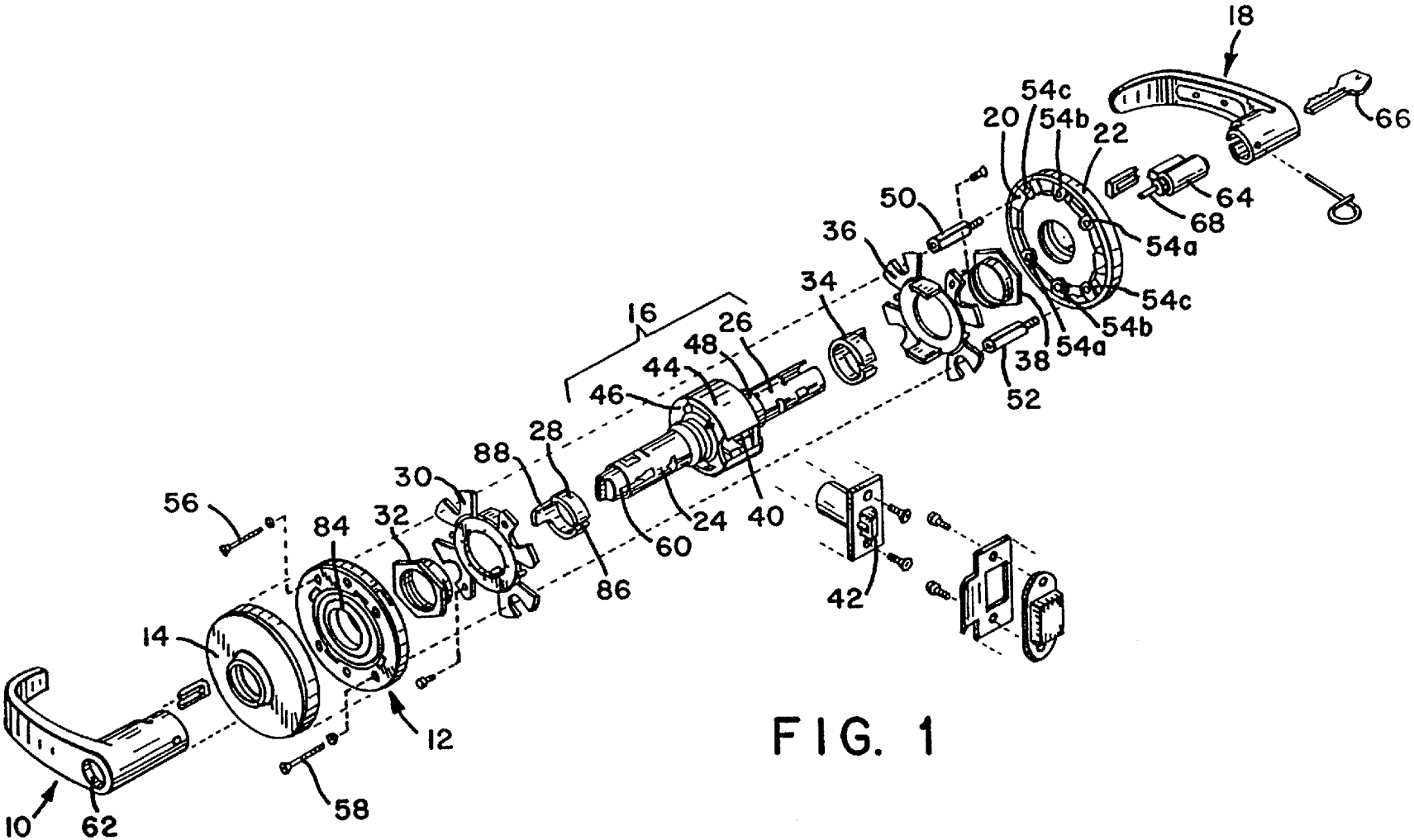
FIG. 1 is an exploded perspective view of the free-wheeling lock mechanism of the present invention.

FIG. 1 provides an exploded view of a free-wheeling lock incorporating a free-wheeling lock mechanism according to the present invention. The free-wheeling lock includes on the inner side of a door (not shown) an inner lever handle 10 and an inner rose 12 covered with a scalp 14. Lever handle 10 is mounted on cylindrical lock body assembly 16 which is conventionally mounted projecting through the door between the inner and outer sides. On the outside of the door is outer lever handle 18 and outer rose 20 covered with an outer scalp 22.

The lock is mounted in the bored opening of a door (not shown) which receives the cylindrical lock body assembly 16. The inner and outer roses 12, 20 and their corresponding decorative scalps 14, 22 cover opposite sides of the bored opening in the door to hide the central portion of the lock body assembly 16. Inner spindle 24 and outer spindle 26 project outward from the door through the inner and outer roses and into non-rotatable engagement with the corresponding handles 10, 18.

The inner spindle 24 extends through inner spacer 28, plate 30, nut 32 and the inner rose and scalp 12, 14 to engage the inner lever handle 10. In a similar fashion, the outer spindle 26 extends through the outer spacer 34, outer mounting plate 36, outer nut 38 and through the outer rose/scalp 20, 22 and into the outer lever handle 18.

The inner portion of the lock body assembly 16 includes a latch retractor 40 which engages latch bolt 42 and retracts it to open the door. Latch retractor 40 is held within latch housing 44 and the spindles 24, 26 extend outwards from the housing 44 through bearings 46, 48.

Inner castle nut 32 and outer castle nut 38 are threaded onto exterior threads on the inner and outer bearings 46, 48 and are tightened to hold inner and outer mounting plates 30, 36 against the opposed inner and outer surfaces of the door. Through studs 50, 52 are threaded into appropriate pairs of opposed mounting holes 54*a*, 54*b* or 54*c* corresponding to pre-drilled mounting holes in the door and extend through notches provided in mounting plates 36 and 30. Screws 56 and 58 engage the internally threaded ends of through studs 50 and 52 and hold the entire lock comprising the lock body assembly 16, the opposed roses 12, 20 and scalps 14, 22, the opposed mounting plates 30, 36 and their castle nuts 32, 38 firmly in position. This prevents any rotation of the lock mechanism 16 relative to the door.

Inner spindle 24 includes a locking button 60 which extends through opening 62 in inner handle 10. Outer lever handle 18 includes a lock cylinder 64 held by outer spindle 26 and outer handle 18. The lock cylinder 64 projects through outer lever handle 18 so that it can be operated by key 66. With key 66 inserted into lock cylinder 64, lock cylinder tail 68 may be rotated to lock and unlock the door (as described more fully below).

When button 60 is pressed inward, the door is also locked. Button 60 is spring-loaded and may be rotated when depressed between two different positions. In a first position, depressing the button causes it to latch temporarily, but the button immediately springs back and returns to the unlocked condition whenever the door is opened. In the second position the button is permanently held in which keeps the door locked even after it is opened.

Figure 2:
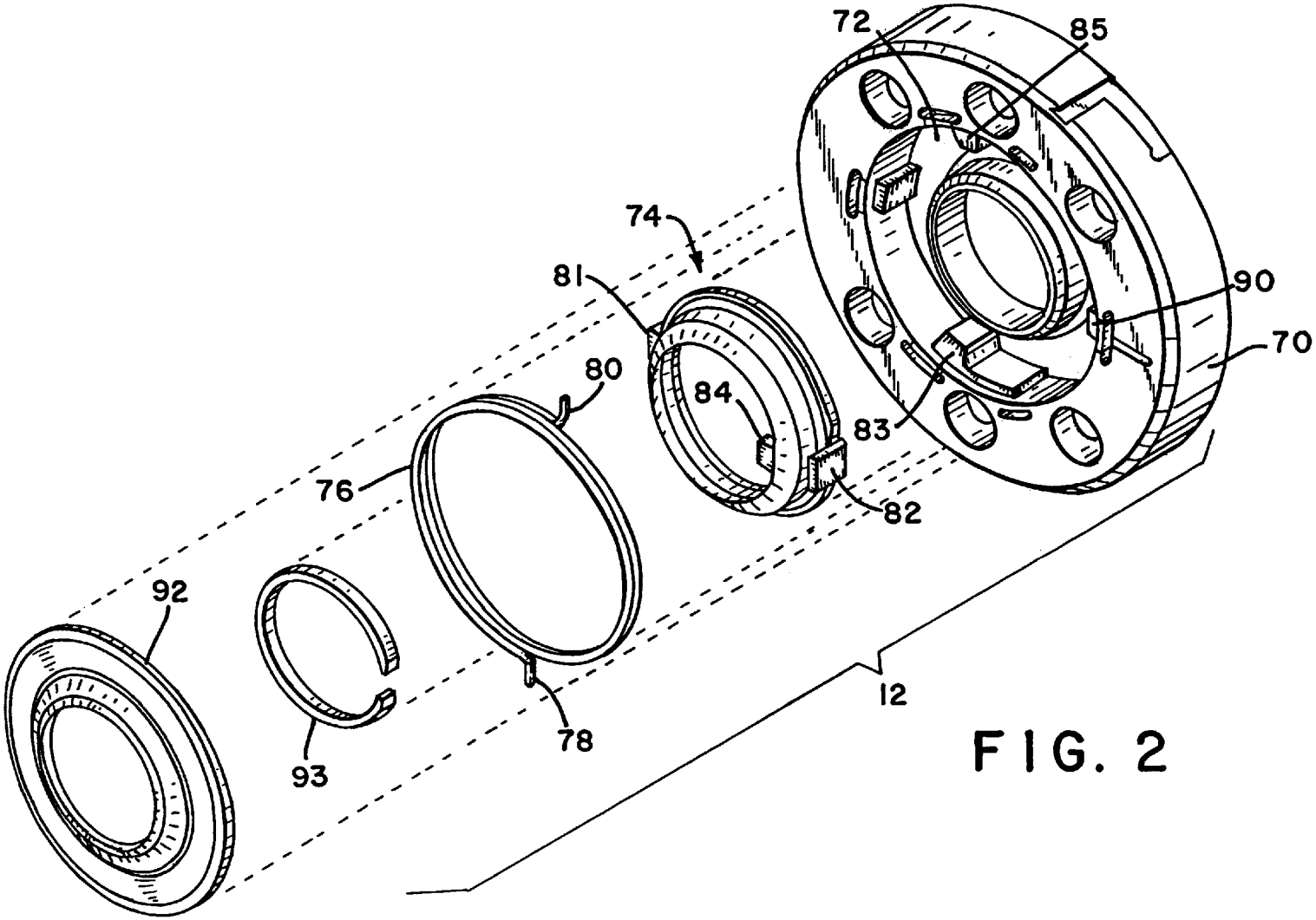
FIG. 2 is an exploded perspective view of the rose that is shown fully assembled in FIG. 1.

Referring to FIG. 2, an exploded view of rose 12 shows that the rose includes a rose body 70 having a channel 72 within which rotates spring driver 74. Before installation, spring 76 is tightened and compressed by drawing the two upturned ends 78, 80 towards each other. This reduces the diameter of the spring and allows it to fit within channel 72. As spring 76 is compressed, upturned ends 78, 80 move towards each other until they pass, allowing them to be positioned on opposites sides of longitudinally extending flange 82 (on the spring driver 74) and on opposite sides of tab 90 (on the rose body 70).

The spring force provided by the two upturned ends of the spring 76 brings longitudinally extending flange 82 into rotational alignment with tab 90 on the rose body 70. Any rotation of the spring driver 74 relative to the rose body 70 compresses the spring further as the flange 82 moves away from tab 90. One of the upturned ends 78, 80 is always captured by the tab 90 and the other is always captured by the flange 82. As these two elements move out of rotational alignment, the spring is compressed and acts to return the spring driver back to its starting position.

An inwardly extending stub 84 on the spring driver 74 engages slot 86 in spacer 28. Spacer 28 non-rotatably engages lever handle 10 through spacer finger 88 (see FIG. 1). Through this connection the spring 76 always returns the lever handle to the horizontal orientation regardless of which way the handle is turned.

Tab 81 on spring driver 74 allows the spring driver to rotate over a limited range of motion between stops 83 and 85 on the rose body 70. The permitted range of motion is sufficient to prevent a vandal from standing or jumping on the end of the extended lever handle. At the limit of motion, tab 81 contacts stop 83 or 85. The limited rotation provided by tab 81 and stops 83 and 85 is important in protecting the internal components of the lock against excessive torque when the lock mechanism is locked and free-wheeling. If an attempt is made to over-rotate the lever handle beyond its permitted range of motion, tab 81 transfers the torque load from the handle to the rose body through stops 83 and 85, and from there to the door.

Cover 92 encloses the spring and spring driver to hold them within channel 72. Guide 93 helps maintain proper positioning and functioning of the spring and spring driver. This construction allows the rose and spring to be prepared separately from other components of the lock mechanism in a fully assembled and sealed configuration with the cover 92 holding all the internal components of the rose 12 within the channel 72. This simplifies assembly in the factory and in the field.

Exterior rose 20 is substantially identical to interior rose 12 except that the exterior rose body includes threaded mounting holes 54*a*, 54*b* or 54*c* which receive the studs 50, 52 while the interior rose body includes holes for receiving screws 56 and 58 which engage the studs.

Figure 3:
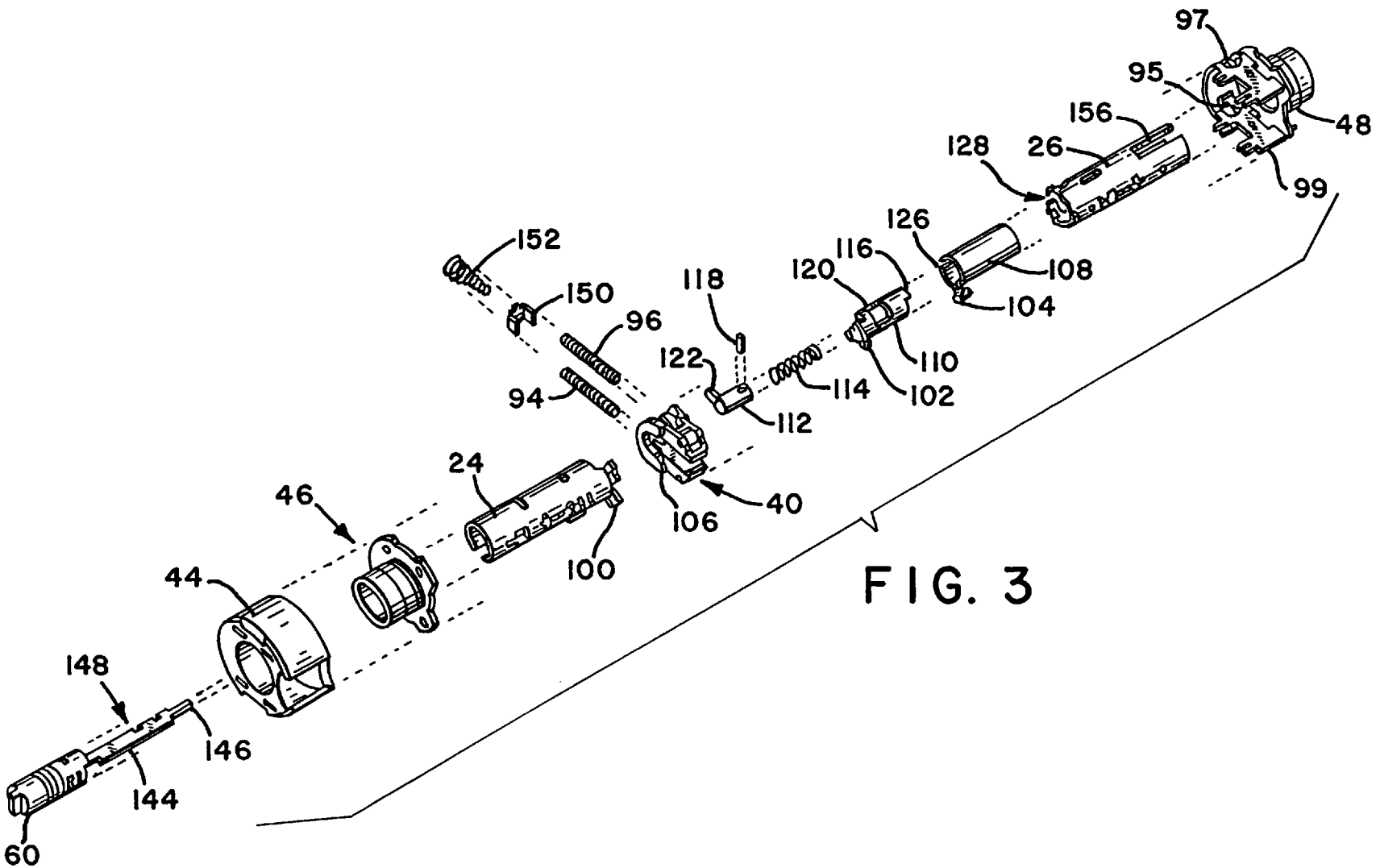
FIG. 3 is an exploded perspective view of a first embodiment of the lock body assembly that is shown fully assembled in FIG. 1.

FIG. 3 is an exploded view of the lock body assembly 16 and provides a detailed look at the components used in a first embodiment of the invention. In the center of the lock body assembly 16 is the latch retractor 40 which is located between bearings 46 and 48, inside of housing 44. Springs 94 and 96 are held on two corresponding projections 95, 97 which extend forward from inner housing 99. The springs 94, 96 urge the latch retractor 40 forward and the two projections 95, 97 help guide the springs and the latch retractor as it moves forward and back.

In the preferred design, inner housing 99 is formed from a single piece of relatively thick metal bent into an approximately U-shape. The projections 95, 97 are also part of this single piece. In prior art designs, the inner housing has previously been constructed of multiple pieces, generally including at least three to seven separate pieces assembled into an inner housing.

The latch retractor 40 connects to the latch bolt 42 and the forward pressure of springs 94, 96 cause the latch bolt to extend and lock the door unless the latch retractor 40 is actively retracted to compress the springs 94, 96. This retraction may be accomplished by any one of the retracting "ears" 100, 102 or 104.

The basic operation of the different ears 100, 102, 104 is identical. The ears are carried on the perimeter of cylindrical elements (to be described) which allows them to be rotated from a forward position to a rearward position by rotating the cylindrical element. Each ear lies against a side face of the latch retractor 40 and is perpendicular to the axis of the cylindrical element on which the ear is carried. As may be seen in FIG. 5, when properly assembled, ears 102 and 104 lie in a single plane that is directly adjacent to the outer side of latch retractor 40 and ear 100 lies on the opposite side directly adjacent to the inner side of the latch retractor.

When an ear is rotated from the forward to the rearward position, it contacts a lip (e.g. lip 106) located along the side face of latch retractor 40. This draws the latch retractor back, compressing springs 94, 96 and retracting the latch bolt.

The operation of the inner side of the lock mechanism may now be described in detail. The inner lever handle 10 is non-rotatably connected to the inner spindle 24. Ear 100 is carried on the inner spindle 24 and contacts lip 106 whenever the inner spindle is rotated—which occurs whenever the inner handle is turned. Rotation of the handle 10 causes the ear 100 to move from its forward position (as shown in FIG. 3) towards a more rearward position, contacting lip 106 and driving the latch retractor 40 back to compress springs 94, 96 and open the door. This happens regardless of which way handle 10 is turned. The angular size of ear 100 is sufficient to always contact the lip 106 regardless of which way it is turned, and it may be a double element (as shown) or it may be a single element.

The operation of the outer side of the lock mechanism is somewhat more complex as there are two ears (102, 104) and neither one is directly linked to either the handle or the spindle. Nonetheless, the two ears 102, 104 operate in fundamentally the same way as described for ear 100. Ear 102 is carried on inner cam 110 and ear 104 is carried on outer cam 108. The two ears are each about half the size of the single ear 100 on the inner mechanism side. Each of the cams (inner and outer) is cylindrical and may be rotated under certain conditions to rotate the corresponding ear. The ears 102, 104 contact a lip on the opposite side of latch retractor 40 from lip 106 to retract the latchbolt whenever the inner cam 110 or outer cam 108 is rotated.

Because the ears lie in a single plane, they contact each other and cooperate to retract the latch. More specifically, when an ear is turned in one direction, it directly contacts the lip on the latch retractor to retract the latch bolt. When turned in the opposite direction, the ear pushes on the adjacent ear which retracts the latch retractor.

Outer spindle 26 is hollow and extends through bearing 48 and connects non-rotatably with outer lever handle 18. Outer cam 108 carries outer cam ear 104 on its perimeter and is rotatably held within hollow spindle 26. Inner cam 110 carrying ear 102 fits within the hollow central opening of outer cam 108 and is rotatably held therein. Locking plug 112 slides into the hollow central opening of inner cam 110 and is axially and rotationally slidable relative to the inner cam.

Locking plug spring 114 urges the locking plug 112 towards the latch retractor 40. Locking plug spring 114 is inserted into an open end of the inner cam 110 and rests against a partially closed end 116 of the inner cam 110. Locking plug 112 holds the locking spring 114 in the central opening of inner cam and is held in the central opening by a pin 118 which extends outward from the locking plug 112 and into a capture slot 120 formed in inner cam 110.

The capture slot 120 captures the projecting outward end of pin 118 and allows the locking plug 112 to slide axially for a limited distance to compress spring 114 and to rotate for a limited angular distance to move an outwardly projecting finger 122 as will be described below.

The operation of finger 122 and locking plug 112, and their relationship and position relative to the surrounding cylindrical elements is critical to the locking and unlocking functionality of the lock mechanism. This relationship can be seen best by reference to FIGS. 4 and 5 which show that the outer lock elements form a set of nested cylindrical elements. Working from the inside towards the outside these elements include locking plug 112 at the center, surrounded by inner cam 110, outer cam 108, outer spindle 26 and the bearing 48 and outer lever handle 18.

Finger 122 extends through an open notched area 124 in the inner cam, which is large enough to allow the inner cam to turn independently of the locking plug. Note that when the mechanism is properly assembled, the pin 118 on the locking plug is captured in the capture slot 120 of the inner cam 110 and does not extend through the open notched area 124 as it appears to do in the partially exploded view of FIG. 4. The open notched area 124 allows axial and rotational movement of the finger 122 relative to the inner cam in the same way that the capture slot allows axial and rotational movement of the pin 118 relative to the inner cam.

Finger 122 extends into outer cam slot 126 in the outer cam, and this connection rotationally couples the finger and locking plug to the outer cam, but leaves the finger and locking plug free to move axially relative to the outer cam. Finger 122 also extends into spindle slot 128 which is generally T-shaped and includes a longitudinal portion 130 and a circumferential portion 132. When the finger 122 is in the longitudinal portion 130 of the spindle slot, the outer cam 108 is rotationally coupled to the outer spindle 26. In this position, rotation of the outer lever handle will turn the outer spindle 26 which will turn the outer cam 108 and its ear 104 to retract the latch. Thus, the door is unlocked whenever the finger 122 is in the longitudinal portion 130 of the spindle slot.

When the finger 122 is in the circumferential portion 132 of the spindle slot, the spindle 26 may still be rotated, but the handle rotation is not coupled to the outer cam 108 due to the circumferential width of the circumferential portion 132 of the spindle slot. Thus, the door is locked and in the free-wheeling mode whenever finger 122 is in the circumferential portion 132 of the spindle slot.

Finger 122 is long enough that its tip 134 extends outward from the outer surface of the outer spindle. When finger 122 is in the circumferential portion 132 of the spindle slot, the finger tip 134 extends into a locking slot 136 in the outer bearing 48. The locking slot 136 locks the finger 122 and prevents any rotational motion of the inner cam 108 whenever the door is locked, regardless of how the handle and spindle are turned. In this way the finger 122 performs two independent functions as it moves axially. The first function is to disengage the outer cam from the spindle, allowing free-wheeling operation when locked. This occurs when the finger moves into the circumferential portion of the spindle slot. The second function is to affirmatively prevent rotation of the outer cam, which occurs when the finger moves into the locking slot 136 in the outer bearing 48.

When the finger 122 is in the longitudinal portion 130 of the spindle slot, the tip of the finger 134 extends into an arcuate rabbet 138 which extends around the inner periphery of the bearing 48. The rabbet 138 allows the finger to rotate relative to the bearing as is necessary when the handle is turned.

Rabbet 138 also acts to hold the outer spindle 26 in the bearing by capturing protrusions 140, 142. These protrusions prevent the outer spindle 26 from passing completely through the bearing 48.

When the locking plug is in the locked position, it completely prevents the outer cam 108 from turning. However, the inner cam 110 is connected to the lock cylinder 64 via the lock cylinder tail 68 and may be turned by the key 66 due to the clearance provided by the open notched area 124 and the capture slot 120 as described above. These clearances permit the inner cam 110 to be turned sufficiently to rotate the ear 102 and retract the latchbolt.

From the description above, it will be understood that the door is locked and free-wheeling when the locking plug is moved axially towards the outer side of the door. The door is unlocked when the locking plug is allowed to return (under the return force of spring 114) towards the inner side of the door. This axial motion is controlled by button 60 which includes actuator 144 (See FIG. 3).

Actuator 144 extends through the lock mechanism from the inner side to the outer side where an end 146 of the actuator makes contact with the locking plug 112. When button 60 is pressed inward, it pushes locking plug 112 to the locked position described in detail above. As this happens, a pair of engaging slots 148 on the actuator come into alignment with catch 150. Catch 150 is positioned inside the inner housing 99 and catch spring 152 operates between the inner housing 99 and the catch 150 to press the catch forward. As the engaging slots 148 come into alignment with the catch, the blade ends of the catch enter the corresponding slots 148 and prevent the button 60 from moving back towards the unlocked position.

When retractor 40 is pulled back, however, catch 150 releases the engaging slots 148 and the button 60 returns to the unlocked position. The button 60 is typically returned to its unlocked position by an internal button spring, however, this motion is also assisted by the locking plug spring 114.

Retractor 40 may be pulled back by operating the inner lever handle to open the door, or by operating the lock from the outside with lock cylinder 64 and key 66. As the latch retractor moves to the rear, the catch 150 releases the actuator slots 148, the button 60 pops out and the locking plug returns to the unlocked position.

Button 60 may also be pressed inward and rotated to hold it in the locked position. This is achieved conventionally with an L-shaped slot and engaging tab on the button (not shown).

Figure 4:
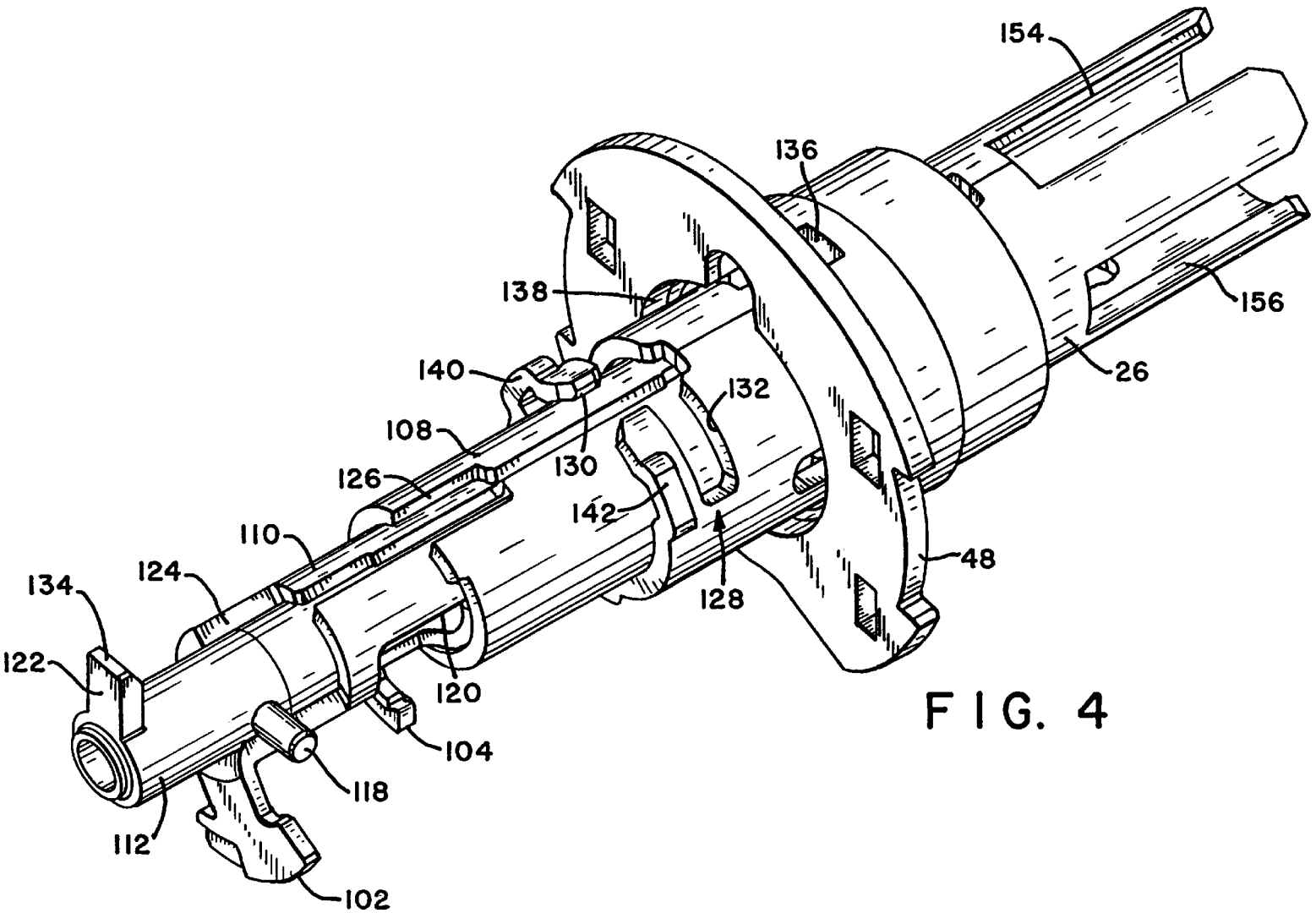
FIG. 4 is a perspective view showing elements of the lock body assembly of FIG. 3 in a partially disassembled state.
Figure 5:
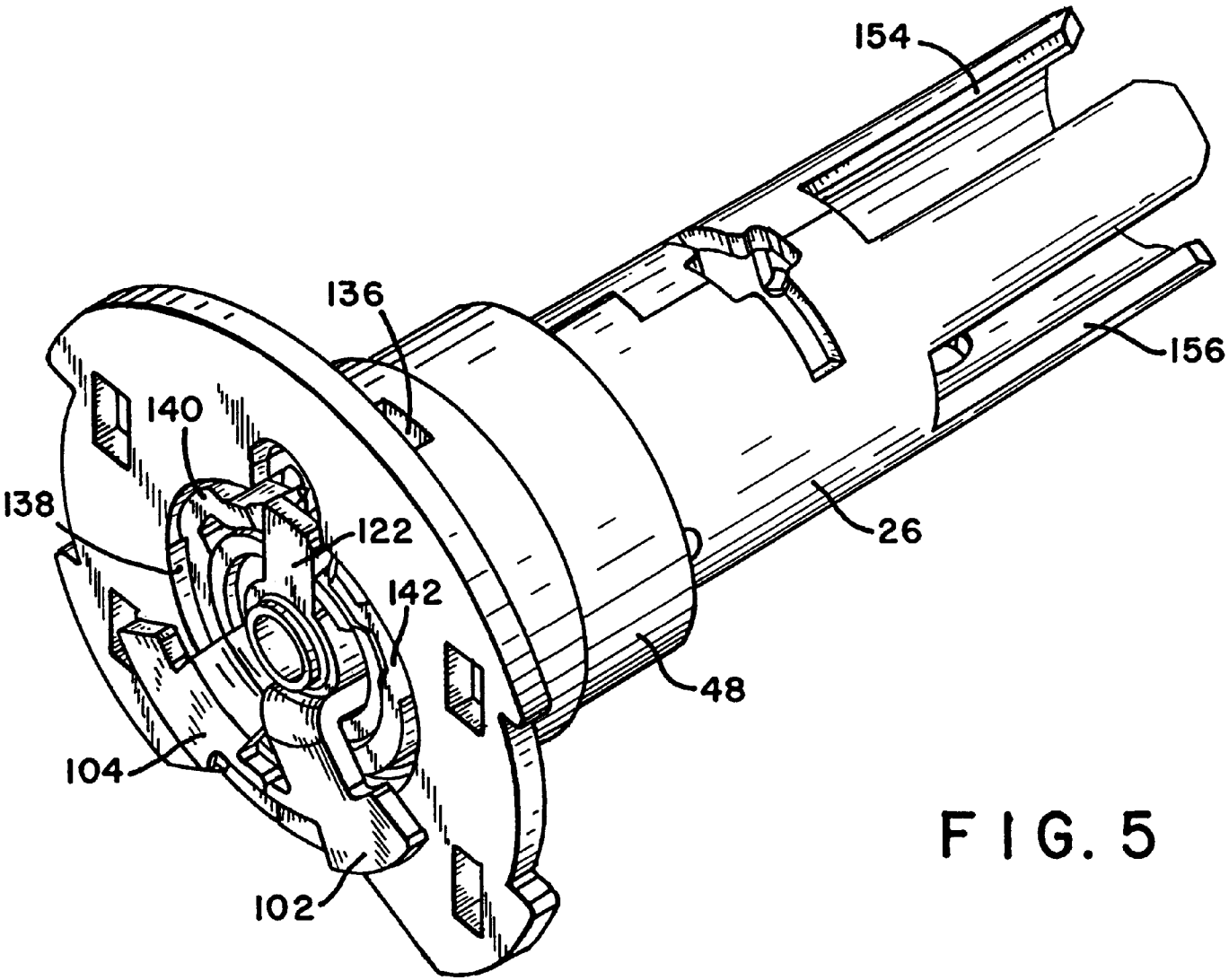
FIG. 5 is a perspective view showing the same elements of the lock body assembly seen in FIG. 4 except the elements are shown fully assembled and in the unlocked position.

FIGS. 4 and 5 also show a pair of notches 154, 156 in the outer spindle used to non-rotatably connect the outer lever handle 18 and the lock cylinder 64 to the outer spindle 26.

FIG. 5 shows the outer lock mechanism in the assembled configuration with the finger 122 in the longitudinal portion of the spindle slot, i.e. in the unlocked position.

Figure 6:
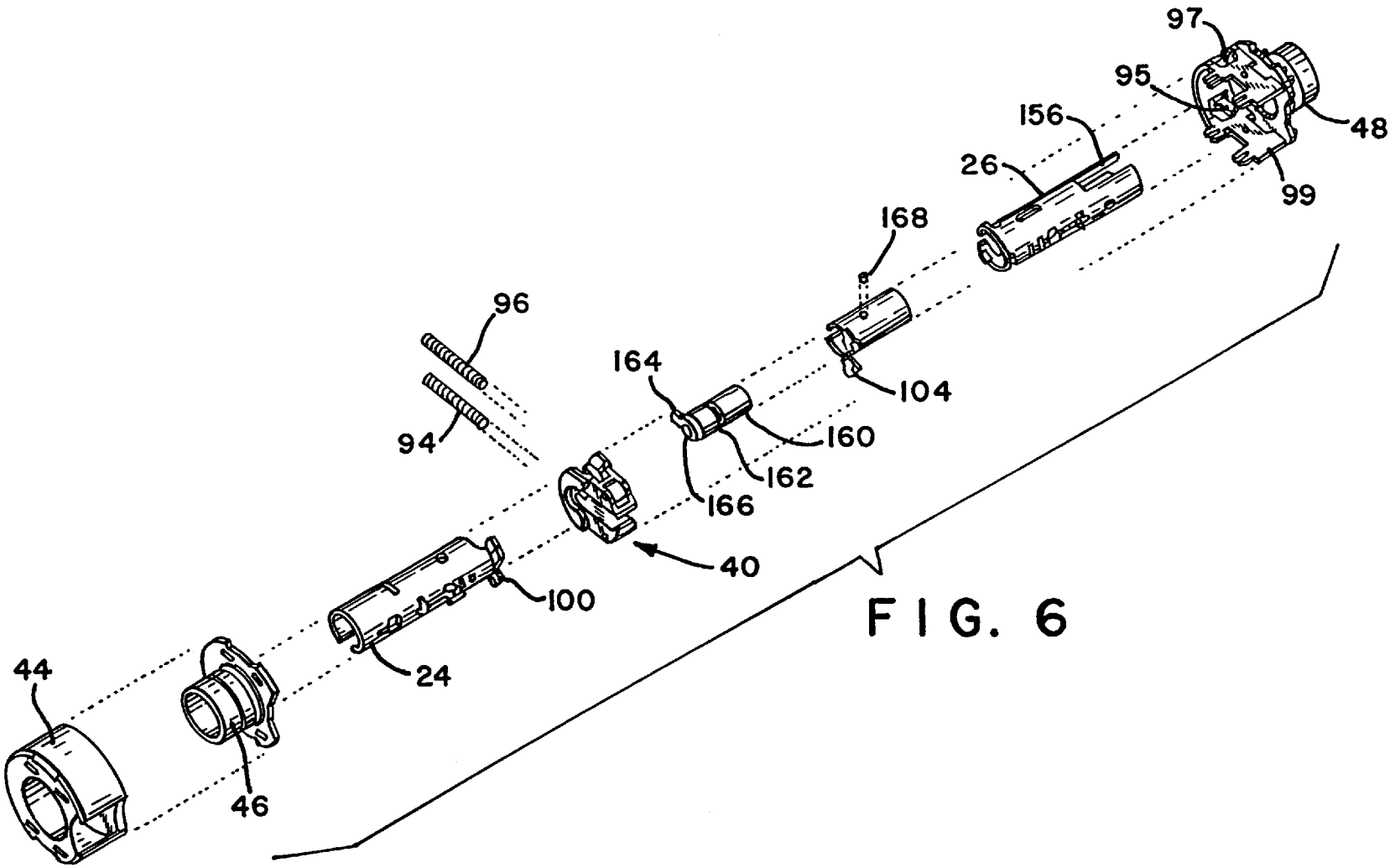
FIG. 6 is an exploded perspective view of a second embodiment of the lock body assembly that is shown fully assembled in FIG. 1.
Figure 7:
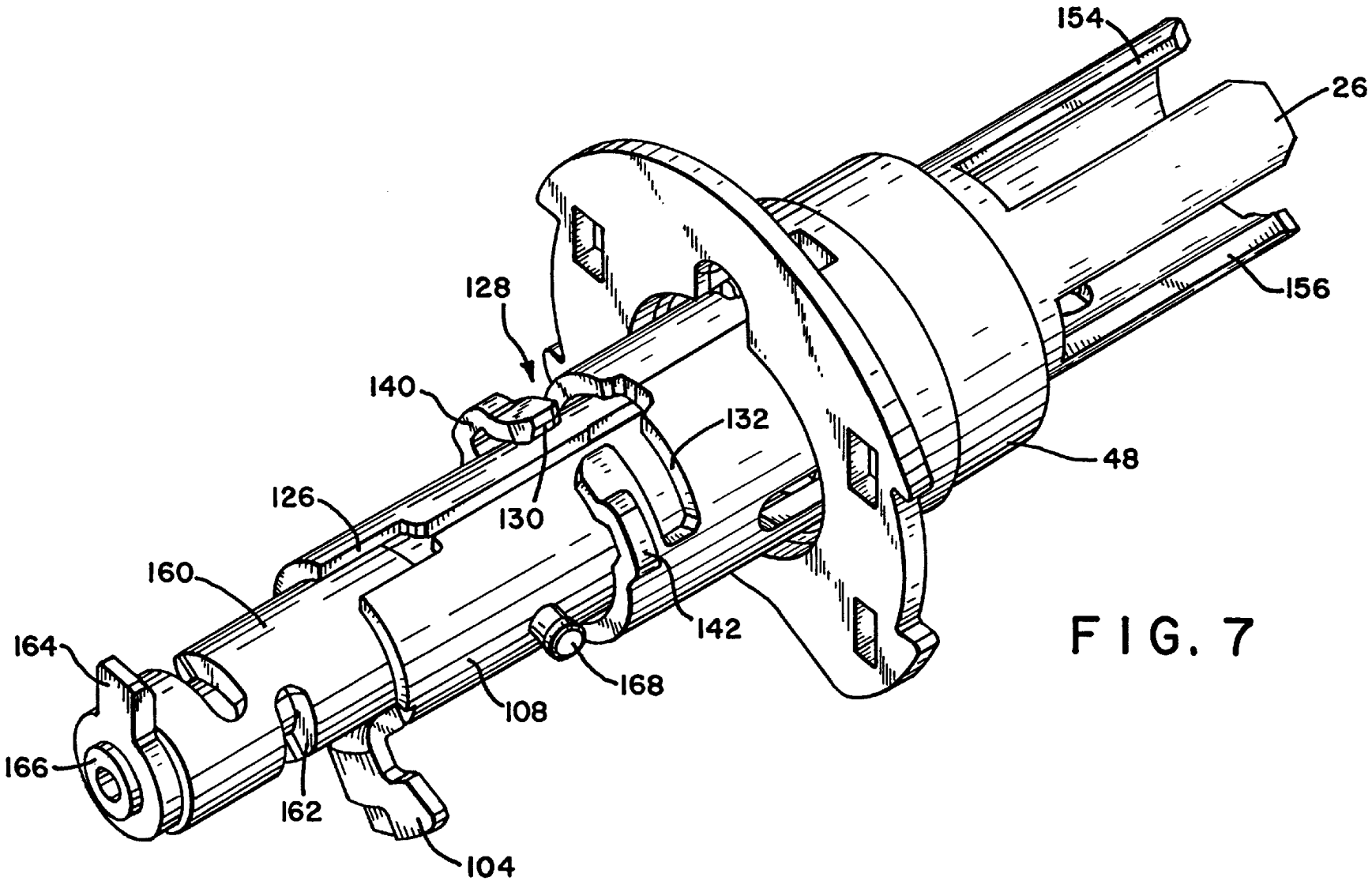
FIG. 7 is a perspective view showing elements of the lock body assembly of FIG. 6 in a partially disassembled state.

FIGS. 6 and 7 show an alternative embodiment of the invention in which the door is locked and unlocked solely by the key, and the button 60 is eliminated. In this design, the inner cam and small locking plug of FIGS. 3–5 have been replaced by a larger locking plug 160 provided with a spiral groove 162. In the first embodiment described, the locking plug 112 included a rigidly attached and preferably integral finger 122. In this embodiment, however, the corresponding finger 164 is a separate piece from the locking plug 160 and is attached to it by pivot 166. Pivot 166 allows the locking plug 160 to rotate freely around its axis regardless of how the finger 164 is being held.

The spiral groove 162 is engaged by a pin 168 that extends inwardly from the outer cam 108 into the groove. In this embodiment, the lock cylinder tail 68 engages the locking plug 160 (instead of the inner cam as in the previously described embodiment). When the lock cylinder is turned by key 66, the locking plug 160 rotates and moves axially relative to the outer cam due to the spiral action of the spiral groove and the engaging pin 168. The axial motion of the locking plug 160 causes the finger 164 to move axially between the circumferential portion 132 of the spindle slot and the longitudinal portion 130 of the spindle slot to lock and unlock the mechanism substantially as previously described.

Because the locking plug is moved solely by the key in this design, the button 60, actuator 144 and related pieces are not used, and the catch 150 and catch spring 152 are also not needed.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A free-wheeling lock mechanism comprising:

a latch retractor;

a spindle adapted for non-rotatable connection to a handle, the spindle having an axis and a spindle slot, the spindle slot having a longitudinal portion and a circumferential portion;

an outer cam having an outer cam ear and an outer cam slot, the outer cam being rotatably held within the spindle and the outer cam ear retracting the latch retractor when the outer cam is rotated;

a locking plug located within the outer cam having an outwardly projecting finger, the locking plug being axially slidable relative to the outer cam and the spindle from an unlocked position to a locked position, in the unlocked position the finger projecting outwardly through the outer cam slot into the longitudinal portion of the spindle slot and in the locked position the finger projecting outwardly through the outer cam slot into the circumferential portion of the spindle slot, and an inner cam having an inner cam ear, the inner cam being rotatably held within the outer cam and rotatably holding the locking plug, the inner cam ear retracting the latch retractor when the inner cam is rotated.

2. The free-wheeling lock mechanism of claim 1 further including a locking plug spring positioned between the inner cam and the locking plug, the locking plug spring biasing the locking plug to axially slide the finger into the longitudinal portion of the spindle slot.

3. The free-wheeling lock mechanism of claim 1 wherein:

the inner cam includes a central opening for receiving the locking plug and a locking plug spring;

an end of the central opening is at least partially closed to hold the locking plug spring in the central opening, the locking plug spring acting between the locking plug and the inner cam;

the inner cam includes a capture slot; and the locking plug is held in the inner cam by a pin projecting outwardly into the capture slot, the capture slot allowing the locking plug and inner cam to move axially and rotationally relative to each other.

4. The free-wheeling lock mechanism of claim 1 wherein the inner cam ear and the outer cam ear lie substantially in a plane perpendicular to the axis of the spindle adjacent to a side of the latch retractor.

5. The free-wheeling lock mechanism of claim 1 further including a second spindle adapted for non-rotatable connection to a second handle, the second spindle being located on an opposite side of the latch retractor from the first spindle, the second spindle having a second spindle ear acting to retract the latch retractor when the second spindle is rotated.

6. The free-wheeling lock mechanism of claim 5 wherein the second spindle ear lies substantially in a plane perpendicular to the axis of the second spindle and adjacent to an opposite side of the latch retractor from the outer cam ear.

7. The free-wheeling lock mechanism of claim 1 further including:

a lever handle having a hollow shaft receiving and engaging the spindle; and a rose having a spring supporting the lever handle in a horizontal orientation.

8. The free-wheeling lock mechanism of claim 7 wherein the rose includes members adapted to extend through a door to prevent the rose from rotating, the members and rose being adapted for mounting at a plurality of angular orientations to accommodate differing mounting hole locations while continuing to support the lever handle in a horizontal orientation.

9. The free-wheeling lock mechanism of claim 7 wherein the rose includes a stop means for limiting rotation of the lever handle.

10. The free-wheeling lock mechanism of claim 1 further including a locking plug spring biasing the locking plug to axially slide the finger into the longitudinal portion of the spindle slot.

11. The free-wheeling lock mechanism of claim 1 wherein:

the spindle rotates in a bearing having a locking slot; and the finger projects outwardly through the circumferential portion of the spindle slot into the bearing locking slot when the locking plug is in the locked position.

12. The free-wheeling lock mechanism of claim 1 wherein:

the spindle rotates in a bearing;

the bearing includes an arcuate rabbet; and the spindle includes a protrusion turning in the rabbet when the spindle is rotated, the protrusion acting to hold the spindle in the bearing.

13. The free-wheeling lock mechanism of claim 1 further including:

an inner housing having the latch retractor slidingly mounted therein, the inner housing including an approximately U-shaped wall member formed as a single piece; and at least one spring in the inner housing mounted between the wall member and the latch retractor for urging the latch retractor forward.

14. A free-wheeling lock mechanism comprising:

a latch retractor;

a spindle adapted for non-rotatable connection to a handle, the spindle having an axis and a spindle slot, the spindle slot having a longitudinal portion and a circumferential portion, the spindle rotating in a bearing having a locking slot;

an outer cam having an outer cam ear and an outer cam slot, the outer cam being rotatably held within the spindle and the outer cam ear retracting the latch retractor when the outer cam is rotated; and a locking plug located within the outer cam having an outwardly projecting finger, the locking plug being axially slidable relative to the outer cam and the spindle from an unlocked position to a locked position, in the unlocked position the finger projecting outwardly through the outer cam slot into the longitudinal portion of the spindle slot and in the locked position the finger projecting outwardly through the outer cam slot into the circumferential portion of the spindle slot, the finger projecting outwardly through the circumferential portion of the spindle slot into the bearing locking slot when the locking plug is in the locked position, and wherein:

the bearing includes an arcuate rabbet; and the finger projects outwardly through the longitudinal portion of the spindle slot into the rabbet when the locking plug is in the unlocked position, the finger rotating in the rabbet when the spindle is rotated.

15. The free-wheeling lock mechanism of claim 14 wherein:

the outer cam includes a central opening for receiving the locking plug;

the locking plug includes a spiral groove;

the outer cam engages the spiral groove; and the locking plug slides axially relative to the outer cam and spindle when the locking plug is rotated to move the finger from the longitudinal portion of the spindle slot to the circumferential portion of the spindle slot.

16. The free-wheeling lock mechanism of claim 15 wherein the outer cam engages the spiral groove with an inwardly projecting pin.

17. The free-wheeling lock mechanism of claim 15 further including a lock cylinder assembly having a projecting tail and wherein the locking plug includes an opening for receiving the lock cylinder tail, the lock cylinder rotating the locking plug with the lock cylinder tail to move the locking plug between the locked and unlocked positions.

18. A free-wheeling lock mechanism comprising:

an inner lever handle;

an outer lever handle;

a generally cylindrical lock body housing having an inner bearing and an outer bearing;

a latch retractor adapted to retract a latchbolt, the latch retractor being mounted in the lock body housing;

an inner spindle journaled in the inner bearing and non-rotatably connected to the inner lever handle;

an outer spindle journaled in the outer bearing and non-rotatably connected to the outer lever handle, the outer spindle having a spindle slot with a longitudinal portion and a circumferential portion;

an outer cam having an outer cam ear and an outer cam slot, the outer cam being rotatably held within the spindle and the outer cam ear retracting the latch retractor when the outer cam is rotated;

an inner cam having an inner cam ear, the inner cam being rotatably held within the outer cam, the inner cam ear retracting the latch retractor when the inner cam is rotated; and a locking plug slidably held within the inner cam, the locking plug having an outwardly projecting finger and sliding axially relative to the outer cam and the outer spindle from an unlocked position to a locked position, in the unlocked position the finger projecting outwardly through the outer cam slot into the longitudinal portion of the spindle slot and in the locked position the finger projecting outwardly through the outer cam slot into the circumferential portion of the spindle slot.

19. The free-wheeling lock mechanism of claim 18 further including a button lock mechanism mounted in the inner spindle, the button lock mechanism contacting the locking plug and being axially movable to move the locking plug between the locked and unlocked positions.

20. The free-wheeling lock mechanism of claim 19 wherein the latch retractor contacts the button lock mechanism, and the button lock mechanism is rotatable between first and second positions, the first position allowing the locking plug and button lock mechanism to return to the unlocked position whenever the latch retractor is retracted and the second position holding the locking plug in the locked position before and after the latch retractor is retracted.

21. A free-wheeling lock mechanism comprising:

an inner lever handle;

an outer lever handle;

a generally cylindrical lock body housing having an inner bearing and an outer bearing, the outer bearing having a locking slot;

a latch retractor adapted to retract a latchbolt, the latch retractor being mounted in the lock body housing;

an inner spindle journaled in the inner bearing and non-rotatably connected to the inner lever handle;

an outer spindle journaled in the outer bearing and non-rotatably connected to the outer lever handle, the outer spindle having a spindle slot with a longitudinal portion and a circumferential portion;

an outer cam having an outer cam ear, an outer cam slot and an inwardly projecting pin, the outer cam being rotatably held within the outer spindle and the outer cam ear retracting the latch retractor when the outer cam is rotated;

a locking plug slidably held within the outer cam, the locking plug having an outwardly projecting finger and a spiral groove engaged by the pin of the outer cam, the locking plug sliding axially relative to the outer cam and the outer spindle from an unlocked position to a locked position, in the unlocked position the finger projecting outwardly through the outer cam slot into the longitudinal portion of the spindle slot and in the locked position the finger projecting outwardly through the outer cam slot into the circumferential portion of the spindle slot, the finger projecting outwardly through the circumferential portion of the spindle slot into the outer bearing locking slot when the locking plug is in the locked position;

a lock cylinder assembly having a projecting tail, the locking plug including an opening for receiving the lock cylinder tail, and the lock cylinder assembly rotating the locking plug with the lock cylinder tail to move the locking plug between the locked and unlocked positions, and wherein:

the outer bearing includes an arcuate rabbet; and the finger projects outwardly through the longitudinal portion of the spindle slot into the rabbet when the locking plug is in the unlocked position, the finger rotating in the rabbet when the outer spindle is rotated.

* * * * *